United States Patent [19]

Theofanous

[11] Patent Number: 4,526,157

[45] Date of Patent: Jul. 2, 1985

[54] AUTO IGNITION CONVERSION APPARATUS AND METHOD

[76] Inventor: Theos E. Theofanous, 4747 Kester Mill Rd., Winston-Salem, N.C. 27103

[21] Appl. No.: 480,841

[22] Filed: Mar. 30, 1983

[51] Int. Cl.[3] ..... F02P 1/00

[52] U.S. Cl. ..... 123/595; 123/146.5 A; 29/401.1; 29/622

[58] Field of Search ..... 29/622, 401.1; 123/146.5 A, 146.5 R, 595; 200/31 DP

[56] References Cited

U.S. PATENT DOCUMENTS 2,605,368 7/1952 Scott ..... 123/146.5 A

FOREIGN PATENT DOCUMENTS 1253040 11/1971 United Kingdom ..... 123/146.5 A

*Primary Examiner*—Howard N. Goldberg
*Assistant Examiner*—P. W. Echols
*Attorney, Agent, or Firm*—B. B. Olive

[57] ABSTRACT

An electronic auto ignition unit is converted to a non-electronic, conventional type ignition unit by substituting a modified slip fit timing cam for the timing rotor of the electronic unit, a conventional plate-point-condensor assembly and driving the modified cam off the same shaft used to drive the timing rotor of the electronic unit.

8 Claims, 8 Drawing Figures

AUTO IGNITION CONVERSION APPARATUS AND METHOD

DESCRIPTION

Technical Field

The invention relates to electronic and non-electronic auto ignition units and more specifically to a means and method enabling an electronic unit to be quickly converted to a non-electronic unit.

Background Art

The standard non-electronic auto ignition unit, often referred to as a "distributor", typically comprises a housing, a plate within the housing on which are mounted the breaker points, condensor and wiper, a rotor shaft extending through the housing and through the support plate and a rotor assembly which is carried by the shaft. The breaker points which are mounted within the housing comprise a spring biased arm carrying one of two metallic electrodes which intermittently contact one another as a cam on the distributor shaft rotates past and in contact with the arm. Thus, ignition timing pulses are generated in correspondence with the engine speed. The plate on which the breaker points are mounted mounts on another lower plate secured to the stator and has limited rotational movement controlled by the operating arm of the vacuum retard unit to which it is connected.

To improve upon the aforementioned standard automobile distributor, a number of types of electronic auto ignition units have been developed in which the ignition timing pulses are generated by an electromagnetic pulse generator with no moving parts and which eliminate the need for the mechanical breaker points. However, the electronic ignition units have introduced other problems and are also subject to failure. In those instances where replacement parts are difficult to obtain or the available mechanics are not sufficiently experienced to repair the electronic ignition units, many automobile owners are requesting garages to replace the electronic ignition units with the conventional ignition units in order to be able to obtain small repair parts when needed, make simple repairs and also to be able to find mechanics capable of locating and servicing ignition problems.

One type of auto ignition unit which is available and which can be used on British Leyland products such as British made cars sold under the names MG, Triumph, Jaguar, Midget and Spitfire is the so called Lucas distributor. Thus, among car owners who have these types of British made cars there has developed a demand for being able to convert those automobiles equipped with Lucas electronic ignition units to Lucas non-electronic units, i.e. the conventional type distributor. In this regard, it has become impractical to rebuild a Lucas electronic distributor or to convert it to a Lucas type non-electronic distributor. One of the problems has been that in the old conventional type of non-electronic Lucas distributor the cam lobe was made as part of the shaft structure. Thus, in order to convert from a Lucas electronic type ignition unit to a Lucas non-electronic type ignition unit it has been necessary to replace the shaft which drives the timing rotor in the electronic unit with a cam shaft having a cam lobe formed on the shaft for opening and closing the breaker points. Another consideration resides in the fact that the spindle which mounts and drives the electronic unit timing rotor is not interchangeable with the integral cam-shaft component of the non-electronic unit which opens and closes the breaker points. An additional consideration resides in the fact that the cam-shaft components for various of the Lucas non-electronic units are of different length and are therefore not interchangeable.

With the foregoing background in mind, the object of the present invention becomes that of providing a dramatically improved method and means for converting a Lucas type electronic ignition unit to a conventional Lucas type non-electronic ignition unit which does not require installation of a new cam shaft. Furthermore, the invention makes the conversion process so simple that the average car owner can make the conversion himself in an emergency with a simple kit of parts and simple instructions and in an emergency requiring nothing more than a screw driver as a tool. In carrying out the invention, the electronic pickup plate assembly is modified to be a non-electronic breaker point-capacitor type assembly or is replaced by a conventional non-electronic plate assembly and the timing rotor of the electronic unit is replaced by a slip fit cam designed to basically assume the same position as the timing rotor and fit into the same shaft drive arrangement to open and close the breaker points.

Figures 1, 2, 3, 4, 5, 6, 7, 8:
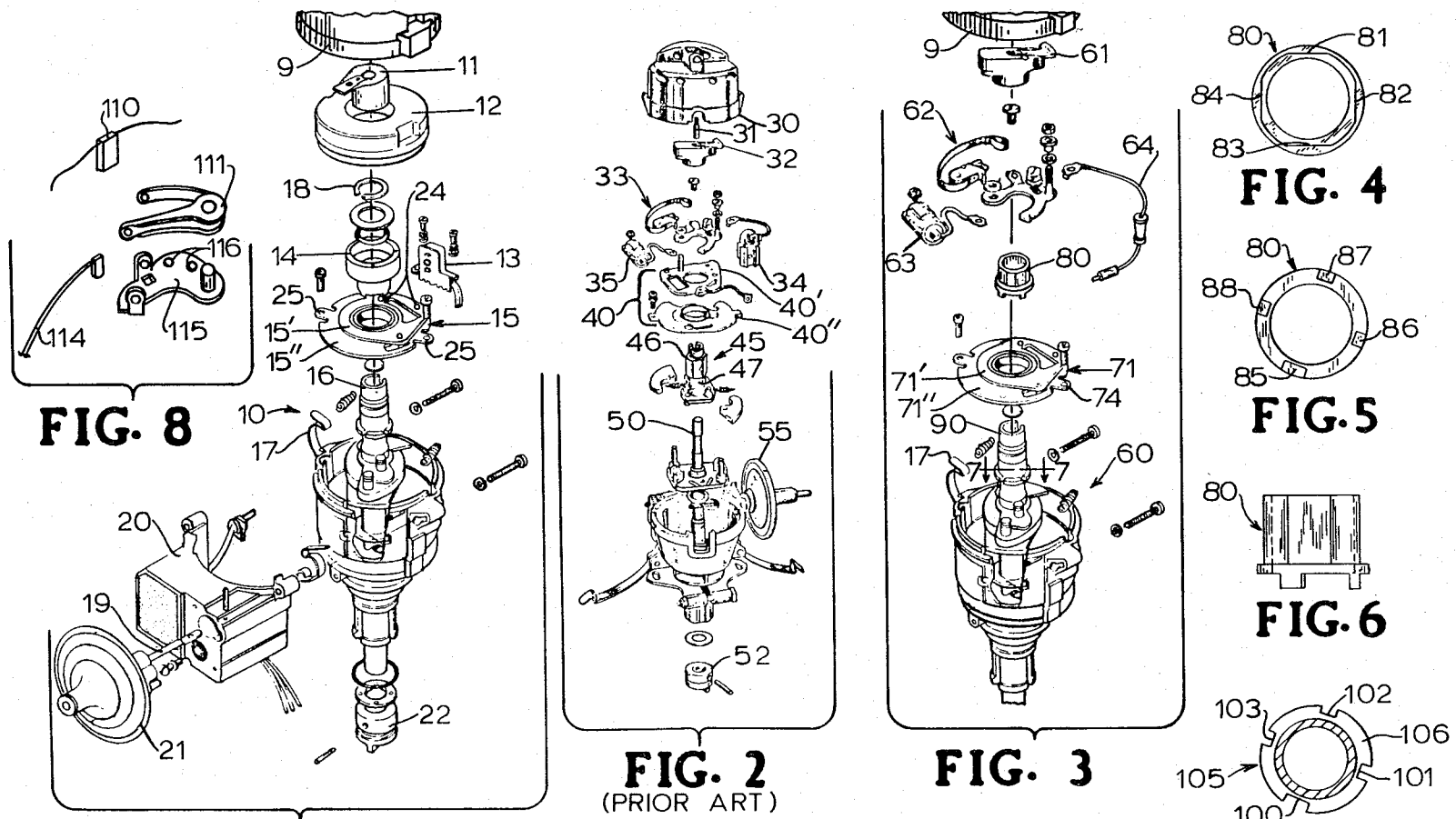
FIG. 1 (PRIOR ART)
FIG. 2 (PRIOR ART)
FIG. 1 is an exploded view of selected major components of a conventional Lucas type electronic auto ignition unit.
FIG. 2 is an exploded view of selected major components of a conventional Lucas type non-electronic unit.
FIG. 3 is an exploded view of a Lucas type electronic unit converted to a non-electronic type unit according to the invention but with the vacuum control unit eliminated for purposes of simplifying the illustration.
FIG. 4 is a top plan view of a slip fit cam forming part of the invention.
FIG. 5 is a bottom plan view of the slip fit cam.
FIG. 6 is a side elevation view of the slip fit cam.
FIG. 7 is a cross sectional view taken generally in the direction of line 7—7 of FIG. 3 and showing the shaft notch arrangement used to drive the timing rotor in the Lucas electronic ignition unit and which is also used to drive the slip fit cam of the present invention.
FIG. 8 is an exploded view of an alternative breaker point assembly adapted to be secured to the existing electronic plate assembly.

Best Mode for Carrying Out the Invention

In a broad sense, the invention is directed to converting the Lucas type electronic auto ignition unit as seen in FIG. 1 to essentially operate like the conventional Lucas type non-electronic auto ignition unit as seen in FIG. 2. The initial description will first be directed to describing the principle components of the electronic unit of FIG. 1 and the non-electronic unit of FIG. 2 and from this explanation, the description will refer to how the converted non-electronic unit of FIG. 3 is achieved using the slip fit cam of the invention as illustrated in FIGS. 4–6.

Making specific reference to FIG. 1, there is shown in an exploded view, the principal components of a Lucas type electronic auto iginition unit 10. Referring specifically to FIG. 1, the illustrated components of the Lucas type electronic auto ignition unit include a cover 9, a rotor arm 11, an anti-static/moisture shield 12 held by C-clamps 17, the pickup vent 13, the timing rotor 14 held by retainer clamp 18, the base plate assembly 15 secured by fastener holes 25 and the spindle 16 which mounts and drives the timing rotor 14. The pick up vent 13 mounts on the upper plate 15' which has limited rotative motion on the lower plate 15" and a connection to the operating arm 19 of the vacuum control unit 21 used to retard or advance the timing. Though not required for purposes of the converted non-electronic unit of the present invention, the Lucas type electronic unit as illustrated in FIG. 1 further includes an amplifier module 20. Spindle 16 is driven by drive dog 22 such that timing rotor 14 rotates proportional to the speed of the engine and in conjunction with pickup vent 13 detecting the metallic bars in the timing rotor 14 produces the required ignition timing pulses for distribution to other components not shown.

For purposes of comparing the Lucas electronic auto ignition unit with the Lucas non-electronic ignition unit, the major components of the more conventional, non-electronic Lucas unit are illustrated in FIG. 2. Making reference to FIG. 2 specifically, the conventional auto ignition unit includes a cover 30, a carbon brush and spring set 31, a rotor arm 32, a breaker point assembly 33, a terminal 34 for the coil lead (not shown), a condensor 35 and a base plate assembly 40. The cam assembly 45 includes a cam 46 formed integrally with its drive base 47. Rotation of cam 46 is achieved by a shaft and action plate assembly 50 driven by drive dog 52. The vacuum control unit 55 operates in the same way as the vacuum control unit 21 previously referred to in reference to FIG. 1. The breaker point assembly 33, terminal 34 and condensor 35 mount on the upper plate 40' of the base plate assembly 40. Upper plate 40' has limited rotative rotation on the secured lower plate 40" and connects to the operating arm of the vacuum control unit 55. A wiper on the breaker point assembly 33 engages cam 46 which opens and closes the breaker points with timing retardation being controlled by the vacuum control retard unit 55 all in a well-known manner.

For purposes of explaining the invention, it will be assumed that the Lucas electronic type unit of FIG. 1 is to be converted to the invention non-electronic unit such as illustrated in FIG. 3 by using selected conventional non-electronic ignition components with the invention slip fit cam 80 and according to the invention method. Use of anti-static/moisture shield 12 is optional. While not shown in FIG. 3, it is also assumed that the vacuum control unit 21, shown in FIG. 1, and the amplifier module unit 20, shown in FIG. 1, will be retained in their normal positions with the amplifier module unit 20 electrically disconnected and the vacuum control unit 21 operating in the same manner as it normally does when used on the Lucas type electronic unit 10 of FIG. 1. Thus, while not illustrated, it should be recognized that the FIG. 3 illustration assumes that the amplifier module unit 20 is attached to the distributor housing seen in FIG. 1 and that the vacuum control unit 21 is also connected and operable for the same purpose and in the same manner as it would be in association with the electronic ignition unit 10 of FIG. 1.

Referring specifically to FIG. 3, it will be noted that there is a rotor arm 61 comparable in construction and function to rotor arms 11 and 32 shown respectively in FIGS. 1 and 2, a breaker point assembly 62, comparable to the breaker point assembly 33 shown in FIG. 2, a condensor 63, comparable to capacitor 35 of FIG. 2, and a coil lead 64. This breaker point, condensor, terminal assembly mounts on the upper plate 71' of base plate assembly 71 comparable to the base plate assembly 40 of FIG. 2. Upper plate 71' has limited rotational movement on the secured lower plate 71" and is connected to the operating arm 19 of vacuum control unit 21. Electrical connections are made in a conventional manner.

What is regarded as a unique and critical component and which lends to simplifying the electronic to non-electronic conversion is the slip fit cam 80 formed of metal, plastic, or the like, and which is so designed that when timing rotor 14 of FIG. 1 is removed, the slip fit cam 80 can be positioned at the same location for the purpose of providing mechanically actuated ignition pulses in contrast to the electronically actuated ignition pulses produced by timing rotor 14. As best seen in FIG. 4, it will be noted that slip fit cam 80 has four cam surfaces 81–84 using a four cylinder engine with four spark plugs as an example of the invention's application. Cam 80 is further provided with four tabs 85–88 with tab 85 being somewhat larger than tabs 86–88. Thus, cam 80 is designed to mount on spindle 90, comparable to spindle 16 shown in FIG. 1, with the large tab 85 being adapted to locate only in the relatively large slot 100 of the drive flange 105 on spindle 90 such that the remaining tabs 86–88 can only be located in the smaller slots 101–103 of drive collar 105. The single large tab 85 could of course be employed without employing the smaller tabs 86–88. A particular advantage is that the seating surface 106 on flange 105 used for seating the timing rotor 14 is also adapted to seat the bottom surface of cam 80 when the tabs and notches are properly engaged. Thus, cam 80 can be located and driven in the same manner as was the timing rotor 14 in the electronic unit. Further, the same notches which control the correct timing position for the metal bars in the timing rotor 14 also effectively control the correct timing position for the respective cam surfaces 81–84. Once the base plate assembly 71 has been fully assembled with the breaker point assembly 62, condensor 63 and coil lead 64, it is secured using the holes 74 comparable to holes 25 of base plate assembly 15 (FIG. 1) in the lower plate 71" which mate with prelocated and already existing holes in the housing or stator portion 60 of the converted unit as seen in FIG. 3. In actual practice, the breaker point assembly 62, condensor 63, coil lead 64 and base plate assembly 71 are preassembled so that all of these parts can be installed as an assembly.

In practicing the invention, the conversion of the auto ignition electronic unit of FIG. 1 to the non-electronic auto ignition unit of FIG. 3 is accomplished very simply. As a first step, the C-clamps 17 of FIG. 1 are released so as to release the anti-static/moisture shield 12 and cover 9. Rotor arm 11 is then removed. Retainer clamp 18 is next removed which allows timing rotor 14 to be removed after which base plate assembly 15 is removed together with the pickup vent 13. At this stage, all electrical wiring connected to electronic unit 10 of FIG. 1 should be disconnected. However, it is again noted that the amplifier module 20 is left in position which also allows vacuum control unit 21 to remain in position for functioning in its normal manner.

The installation procedure is initiated by installing a new plate assembly which basically comprises an assembly including the base plate assembly 71, breaker point assembly 62, coil lead 64 and condensor 63. After this new base plate assembly has been installed, the new slip fit cam 80 of the invention is slipped in place over spindle 16 so as to be located in the manner previously explained and is secured by retainer clamp 18. Rotor arm 61 is now installed after which the appropriate wiring from breaker point assembly 62 and condensor 63 is connected and other appropriate wiring to cover 9 is connected and cover 9 is then installed to complete the installation.

Alternatively, a conventional Lucas base plate assembly as is sold for the non-electronic type unit and with the breaker points, capacitor and terminal pre-installed can be substituted for the base plate assembly found in the original electronic unit rather than fit a breaker point assembly, capacitor and coil lead to the existing baseplate assembly in the existing electronic unit. In the simplest form of conversion, an assembly such as shown in the exploded view of FIG. 8 consisting of a suitable compact condensor 110, a breaker point spring arm assembly 111 and a suitable coil lead 114 can all be preassembled on a mounting plate 115 having holes 116 mating holes 24 in upper plate 15'. In this example the existing base plate assembly would be employed and with a minimum of substitute parts.

Thus, it can be seen that a very simple method and means has been provided by which the average car owner is enabled to quickly convert for an emergency or other reasons a Lucas type electronic ignition system to a Lucas type non-electronic system. While specifically explained in connection with the Lucas type ignition, it is of course recognized that the replaceable slip fit cam of the invention is adapted to be used with any other type of auto ignition of similar construction.

I claim:

1. Apparatus for converting an electronic automotive engine ignition system of the type having:

(a) a distributor with a stator and rotor assembly;

(b) a cover releasably securable to the stator in a fixed position corresponding to the ignition timing and having contacts and wiring receptacles for the engine coil and spark plugs enabling high voltage pulses transmitted from the coil to be transferred to the spark plugs;

(c) a shaft rotatable within and relative to the stator according to engine speed and having intermediate the length thereof an integral slotted flange providing an annular seating surface surrounding the shaft and in a plane perpendicular to the longitudinal axis thereof and through the width of said flange some predetermined number of slots at least one of which is of unique width compared to the remainder of such slots and located in a position corresponding to the timing of said engine;

(d) a vacuum control unit mounted on said stator and having an operating arm extending into said stator;

(e) a pair of prelocated fastener holes in said stator for receiving and supporting a mounting plate assembly surrounding said shaft and having a central opening providing clearance for passage of said flange therethrough when said plate assembly is secured in a plane perpendicular to the longitudinal axis of said shaft;

said apparatus comprising:

(f) a slip fit timing cam mounted on said shaft and having a bottom surface portion seated on said flange seating surface and at least one tab fitting only said slot of unique width forming a drive base connection;

(g) means for securing said cam on said shaft against said flange;

(h) a mounting plate assembly surrounding said shaft and having a central opening providing clearance for passage of said flange therethrough, said plate assembly residing when secured in a plane perpendicular to the longitudinal axis of said shaft and having upper and lower plate members, said lower plate member having a pair of pre-located fastener holes mating said pair of pre-loaded fastening holes in said stator enabling said plate assembly to be secured thereto, said upper plate member being mounted for limited rotation on said lower plate member and having connector means enabling said lower plate member to be detachably connected to said vacuum control unit operating arm for effecting said limited rotation and thereby controlling the relative positions of said upper and lower plate members in correspondence with advancing and retarding the timing of said engine; and (i) a breaker point and condensor assembly mounted on the upper said plate member and having means for appropriately electrically connecting the points and condensor of said assembly to the coil of said ignition system, said breaker point assembly being fixedly positioned on said upper plate and having means for wiping said cam for effecting the opening and closing the points of said assembly in timed relation to the speed of said engine.

2. Apparatus as claimed in claim 1 wherein said plate assembly comprises part of the electronic unit being converted and said breaker point assembly and condensor are mounted thereon.

3. Apparatus as claimed in claim 1 wherein said plate assembly comprises a different plate assembly from the plate assembly associated with the said electronic unit being converted.

4. Apparatus as claimed in claim 1 wherein said timing cam includes a set of tabs formed to fit said slots and including said tab fitting only said slot of unique width.

5. The method of converting an electronic automotive ignition system of the type having:

(a) a distributor with a stator and rotor assembly;

(b) a cover releasably securable to the stator in a fixed position corresponding to the ignition timing and having contacts and wiring receptacles for the engine coil and spark plugs enabling high voltage pulses transmitted from the coil to be transferred to the spark plugs;

(c) a shaft rotatable within and relative to the stator according to engine speed and having intermediate the length thereof an integral slotted flange providing an annular seating surface surrounding the shaft and in a plane perpendicular to the longitudinal axis thereof and through the width of said flange some predetermined number of slots at least one of which is of unique width compared to the remainder of such slots and located in a position corresponding to the timing of said engine;

(d) a vacuum control unit mounted on an amplifier module secured to said stator and having an operating arm extending into said stator;

(e) a mounting plate assembly surrounding said shaft and having a central opening providing clearance for passage of said flange therethrough with said plate assembly when secured residing in a plane perpendicular to the longitudinal axis of said shaft and having upper and lower plate members, said lower plate member having a pair of prelocated fastener holes mating a pair of prelocated fastening holes in said stator, said upper plate member having a pickup vent member secured thereto, said upper plate member being mounted for limited rotation on said lower plate member and having connector means enabling said lower plate member to be detachably connected to said vacuum control unit operating arm for effecting said limited rotation and thereby controlling the relative positions of said upper and lower plate members in correspondence with advancing and retarding the timing of said engine;

(f) a timing rotor operative with said pickup vent and module to produce timing pulses and being mounted on and rotatable with said shaft and having a bottom surface portion adapted to seat on said flange seating surface and a set of tabs formed to fit said slots and to be appropriately located by a respective one of said tabs fitting only said slot of unique width; and (g) a rotor arm mounted on the outer end of said shaft within said cover and being adapted to establish electrical conducting paths through said contacts between the coil and the spark plugs of said ignition system;

comprising the steps of:

(h) removing said cover;

(i) removing and electrically disconnecting said pickup vent;

(j) electrically disconnecting any other electric connections associated with the original said electronic ignition system being converted;

(k) removing said timing rotor and said plate assembly;

(l) replacing said timing rotor with a slip fit timing cam adapted to be mounted on said shaft and having a bottom surface portion adapted to seat on said flange seating surface and at least one tab formed to fit and be appropriately located by said slot of unique width;

(m) replacing said original plate assembly with a plate assembly having a similar upper and lower plate construction as the original said plate assembly and having mounted on the upper plate thereof a conventional set of breaker points with a wiper for engaging said cam to effect mechanical timed opening and closing of said breaker points and also having a condensor mounted on said upper plate;

(n) installing the plate assembly having said breaker points and condensor utilizing said prelocated fastener holes in said stator and establishing a connection between the upper plate of said plate assembly and the operating arm of said vacuum control unit;

(o) completing conventional electrical connections between said breaker points and condensor and other components of said ignition system; and (p) replacing said cover.

6. The method as claimed in claim 5 wherein the step of installing the said plate assembly in the converted said electronic unit comprises installing the original plate assembly of said electronic unit with said breaker points and condensor fitted thereto.

7. The method as claimed in claim 5 wherein the step of installing said plate assembly comprises the step of installing a new plate assembly having mounted thereon said breaker points and condensor.

8. The method as claimed in claim 5 wherein said timing cam includes a set of tabs formed to fit said slots and including said tab fitting only said slot of unique width and including the step of locating said tabs to fit into said slots.

* * * * *